US006676579B1

(12) United States Patent
Lin

(10) Patent No.: US 6,676,579 B1
(45) Date of Patent: Jan. 13, 2004

(54) YOGA BALANCE TRAINER

(75) Inventor: Danny Lin, Mountain View, CA (US)

(73) Assignee: Asia Regent LTD, Taichung (TW)

( * ) Notice: Subject to any disclaimer, the term of this patent is extended or adjusted under 35 U.S.C. 154(b) by 0 days.

(21) Appl. No.: 10/213,753

(22) Filed: Aug. 5, 2002

(51) Int. Cl.[7] ..... A63B 22/16
(52) U.S. Cl. ..... 482/146
(58) Field of Search ..... 482/145–147, 482/70–75, 51, 134, 125, 121, 122, 110

(56) References Cited

U.S. PATENT DOCUMENTS 3,929,329 A * 12/1975 Rivera ..... 272/57
5,484,361 A * 1/1996 Dunn ..... 482/51
5,582,567 A * 12/1996 Chang ..... 482/146

* cited by examiner

*Primary Examiner*—Nicholas D. Lucchesi
*Assistant Examiner*—L Amerson
(74) *Attorney, Agent, or Firm*—Brinks Hofer Gilson & Lione

(57) ABSTRACT

A yoga balance trainer includes a main frame, a base support, and two upright exercising rod units. The main frame has a first spring unit connected between bottom and top boards. The base support includes a number of interconnecting base tubes connected fixedly to the bottom board of the main frame, a plurality of positioning tubes connected removably, telescopically, and respectively to selected two of the base tubes, and positioning units for positioning the positioning tubes respectively relative to the base tubes. Each rod unit includes a lower rod portion connected to one of the selected two of the positioning tubes, an upper rod portion, and a second spring unit connected between the lower and upper rod portions so that the upper rod portion is twistable relative to the lower rod portion.

7 Claims, 17 Drawing Sheets

YOGA BALANCE TRAINER

BACKGROUND OF THE INVENTION

1. Field of the Invention

The invention relates to an exerciser, more particularly to a yoga balance trainer.

2. Description of the Related Art

There are various kinds of exercising equipment available in the market today, such as running machine, stationary bikes, rowing machines, etc. However, exercisers that can provide balance training and soft exercises at the same time are very rare.

SUMMARY OF THE INVENTION

Therefore, the main object of the present invention is to provide a yoga balance trainer that can provide balance training and soft exercises at the same time.

According to the present invention, a yoga balance trainer comprises a main frame, a base support, and at least two upright exercising rod units. The main frame includes a hard bottom board, a hard top board opposite to the bottom board, and a first spring unit connected between the bottom and top boards so as to permit flexible movement of the top board relative to the bottom board. The base support includes a plurality of interconnecting base tubes connected fixedly to the bottom board of the main frame, a plurality of positioning tubes connected removably, telescopically, and respectively to the base tubes, and a plurality of positioning units for positioning the positioning tubes respectively relative to the base tubes. The upright exercising rod units are connected respectively and removably to selected two of the positioning tubes. Each of the exercising rod units includes a lower rod portion connected to the respective one of the selected two of the positioning tubes, an upper rod portion opposite to the lower rod portion, and a second spring unit connected between the lower and upper rod portions so that the upper rod portion is twistable relative to the lower rod portion.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
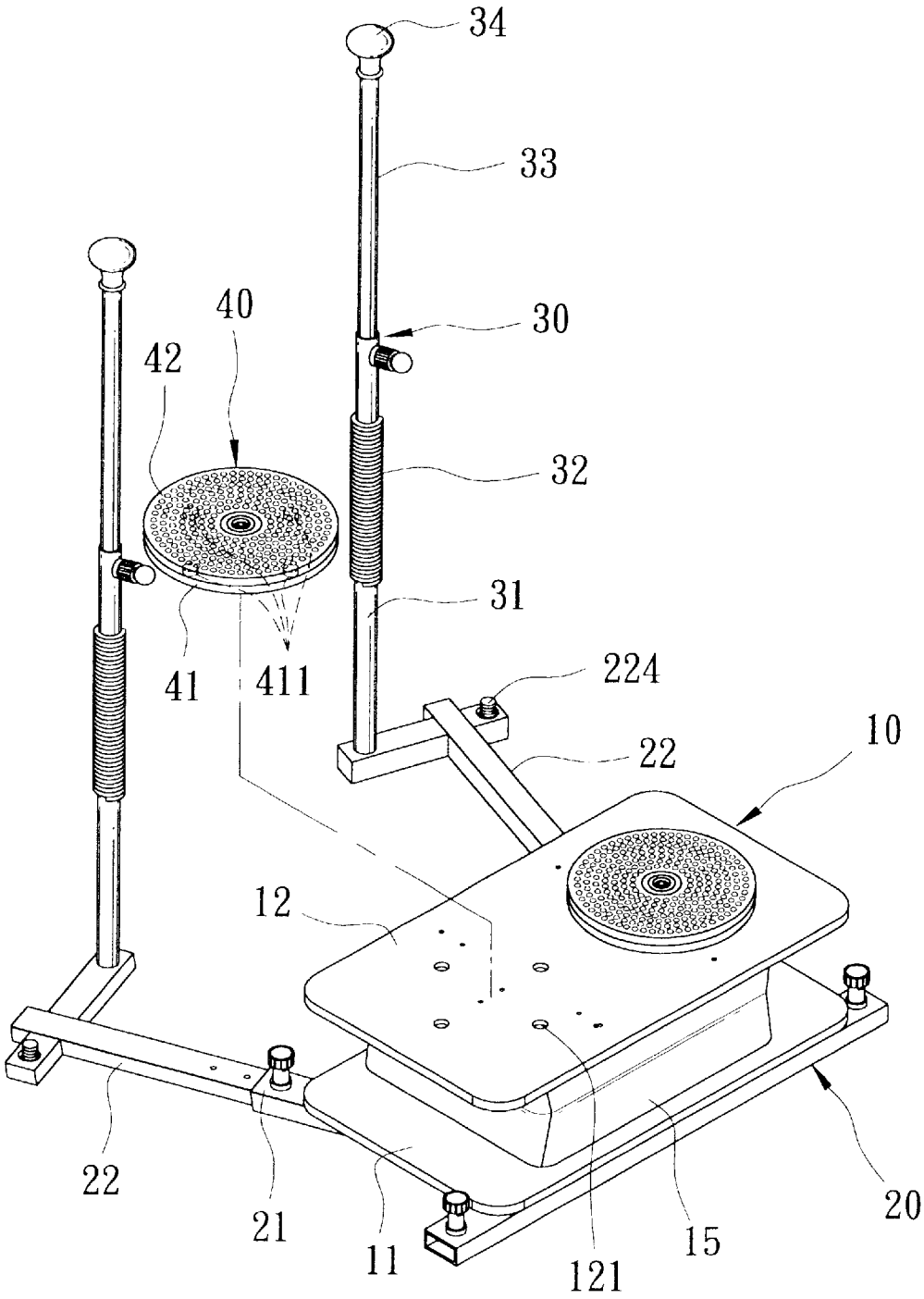
FIG. 1 is a perspective view of the first preferred embodiment of a yoga balance trainer according to the present invention.

Before the present invention is described in greater detail, it should be noted that like elements are denoted by the same reference numerals throughout the disclosure.

Referring to FIGS. 1 to 5, the first preferred embodiment of a yoga balance trainer according to the present invention is shown to comprise a main frame 10, a base support 20, two upright exercising rod units 30, and two horizontal rotatable disc units 40.

The main frame 10 includes a rectangular hard bottom board 11, a rectangular hard top board 12 opposite to the bottom board 11, a first spring unit 13 connected between the bottom and top boards 11, 12, two sound-absorbing cotton layers 14 clamped between the first spring unit 13 and a respective one of the top and bottom boards 12, 11, and a surrounding wall unit 15 surrounding an outer periphery of the first spring unit 13. The top board 12 has an upper surface formed with two sets of four vertical holes 121 (see FIG. 2). The first spring unit 13 includes a plurality of spring members 131, and a plurality of sponge bodies 132 inserted among the spring members 131. The design of the first spring unit 13 permits flexible movement of the top board 12 relative to the bottom board 11. The surrounding wall unit 15 is made of fabric material.

Figure 2:
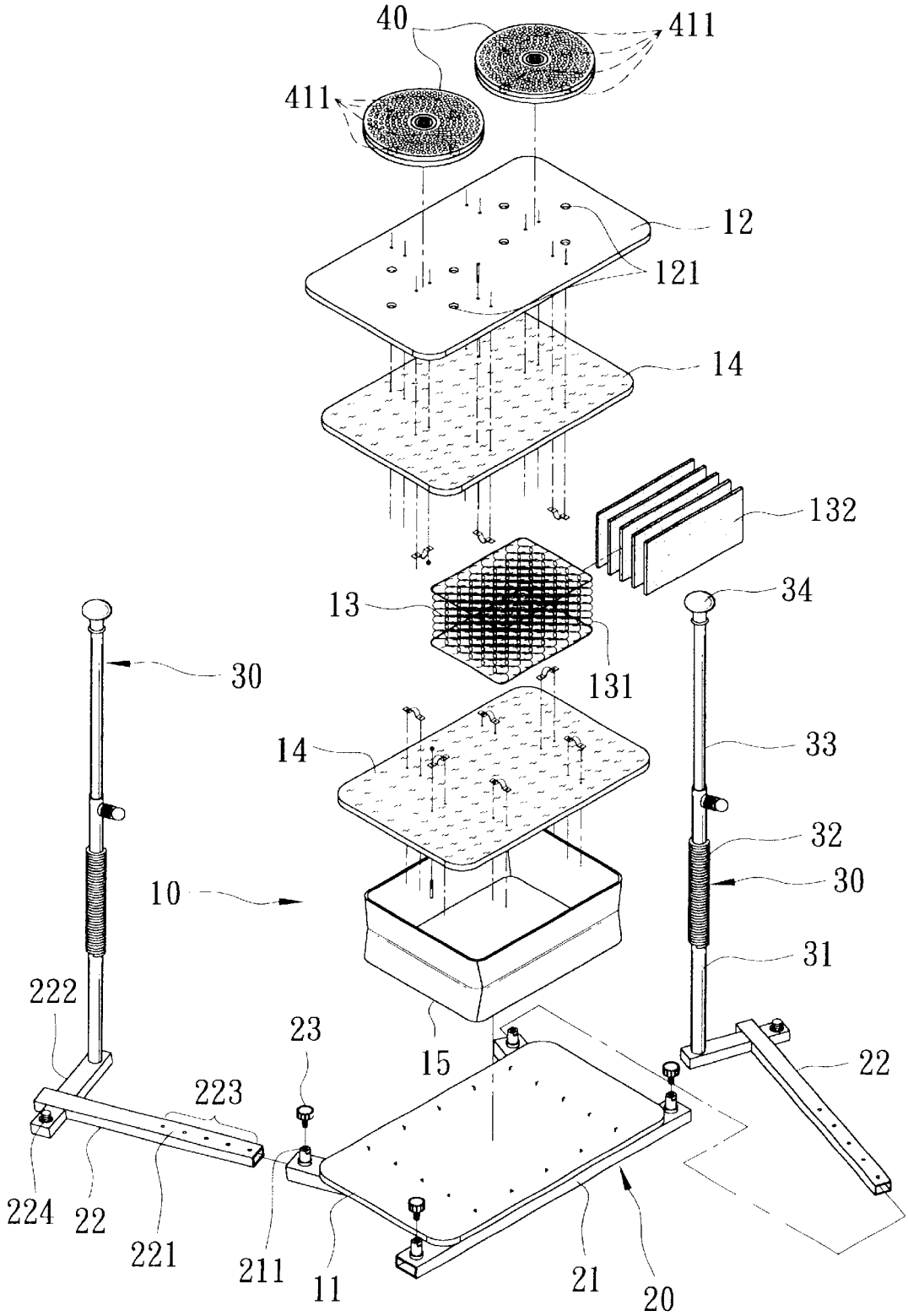
FIG. 2 is a partly exploded perspective view of the first preferred embodiment.
Figure 3:
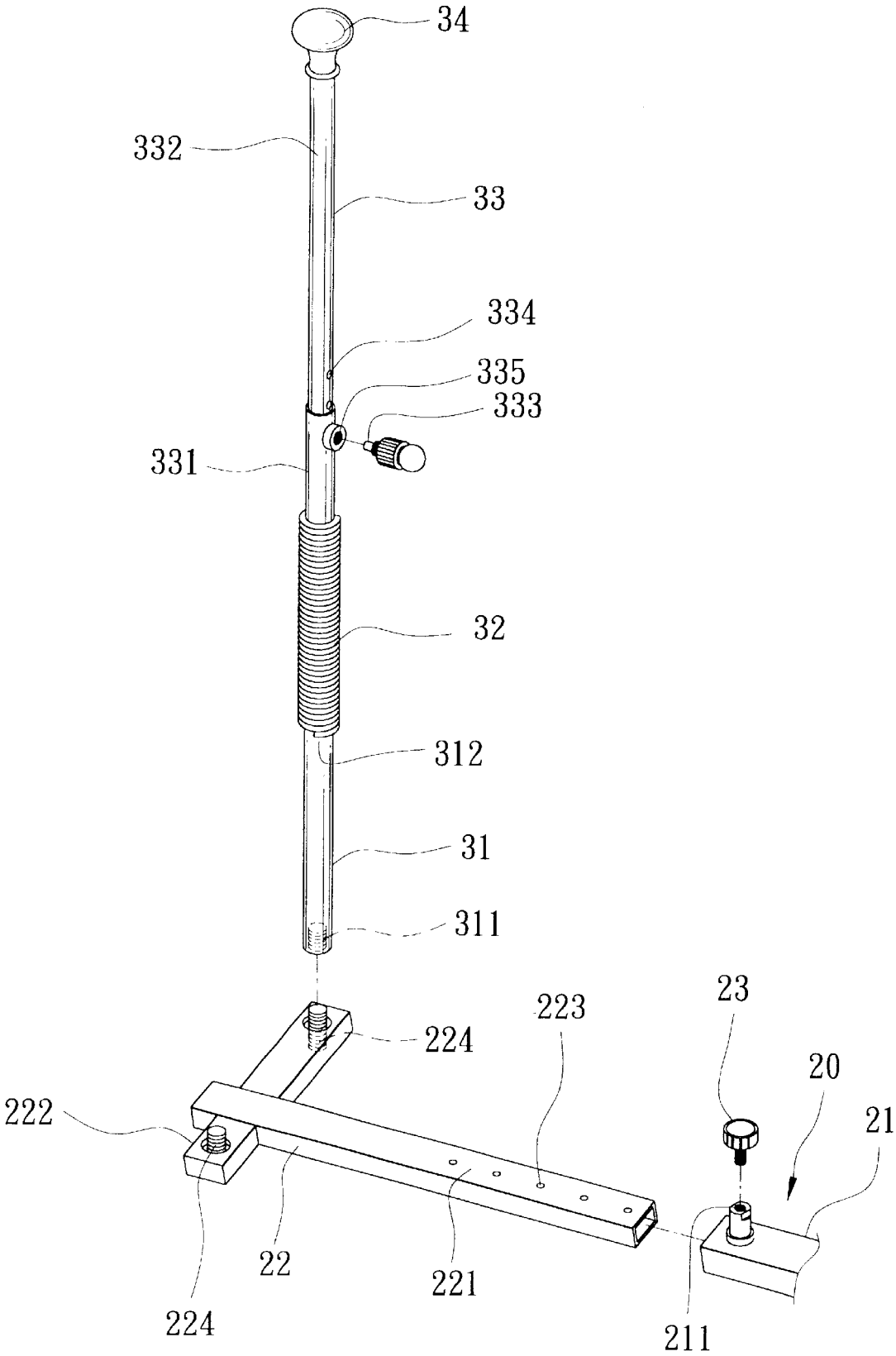
FIG. 3 is a fragmentary partly exploded perspective view illustrating how an upright exercising rod unit is mounted on a positioning tube of the first preferred embodiment.

The base support 20 includes three interconnecting base tubes 21 connected fixedly to and extending outwardly of the bottom board 11 of the main frame 10, a plurality of positioning tubes 22 (only two are shown in FIGS. 1 and 2) connected removably, telescopically, and respectively to the base tubes 21, and a plurality of positioning units for positioning the positioning tubes 22 respectively relative to the base tubes 21. The base tubes 21 are interconnected to each other by means of welding. Each of the positioning tubes 22 includes a sliding rod portion 221 slidably connected to a respective one of the base tubes 21, and a positioning rod portion 222 connected to the sliding rod portion 221 in a perpendicular direction. Each of the positioning units includes a retaining hole 211 formed in a respective one of the base tubes 21, a horizontal row of five positioning holes 223 formed in the sliding rod portion 221 of a respective one of the positioning tubes 22, and a positioning pin 23 extending through the retaining hole 211 in the respective one of the base tubes 21 and into a selected one of the positioning holes 223 such that the protruding length of the positioning tubes 22 can be adjusted respectively relative to the base tubes 21. The positioning rod portion 222 has two opposite ends formed with an externally threaded post 224.

The two upright exercising rod units 30 are connected threadedly, respectively, and removably to selected two of the positioning tubes 22. Each exercising rod unit 30 includes a lower rod portion 31 connected to the respective one of the selected two of the positioning tubes 22, an upper rod portion 33 opposite to the lower rod portion 31, a second spring unit 32 connected between the lower and upper rod portions 31, 33 so that the upper rod portion 33 is twistable relative to the lower rod portion 31, and a rotatable knob 34 connected rotatably on a top end of the upper rod portion 33. The lower rod portion 31 of each rod unit 30 has an internally threaded lower end 311, and an upper end 312 opposite to the lower end 311 and inserted into the second spring unit 32. The lower end 311 threadedly engages one of the posts 224 of the positioning rod portion 222 of a respective one of the positioning tubes 22 so as to position each rod unit 30 on the latter. The upper rod portion 33 of each rod unit 30 includes an outer tube 331 inserted into and fastened to the second spring unit 32, an inner tube 332 inserted adjustably into the outer tube 331, and a retaining pin 333 for retaining the inner tube 332 on the outer tube 331. The outer tube 331 has a retaining hole 335. The inner tube 332 has a vertical row of positioning holes 334. The retaining pin 32 extends through the retaining hole 335 and into a selected one of the positioning holes 334. The second spring unit 32 has a hollow tubular shape made of spiral spring, fiberglass, or rubber materials, so as to permit 360° rotation of the upper rod portion 33 relative to the lower rod portion 31.

Each of the horizontal rotatable disc units 40 is mounted removably on the top board 12 of the main frame 10, and has a horizontal lower disc portion 41 mounted non-rotatably on the top board 12, and a horizontal upper disc portion 42 opposite to the lower disc portion 41 and rotatable relative to the lower disc portion 41. In this embodiment, the lower disc portion 41 of each rotatable disc unit 40 has a bottom surface formed with four positioning posts 411 that engage respectively one set of holes 121 (see FIGS. 1 and 2) in the top board 12 of the main frame 10 so as to prevent rotation of the lower disc portion 41 relative to the top board 12.

Figure 4:
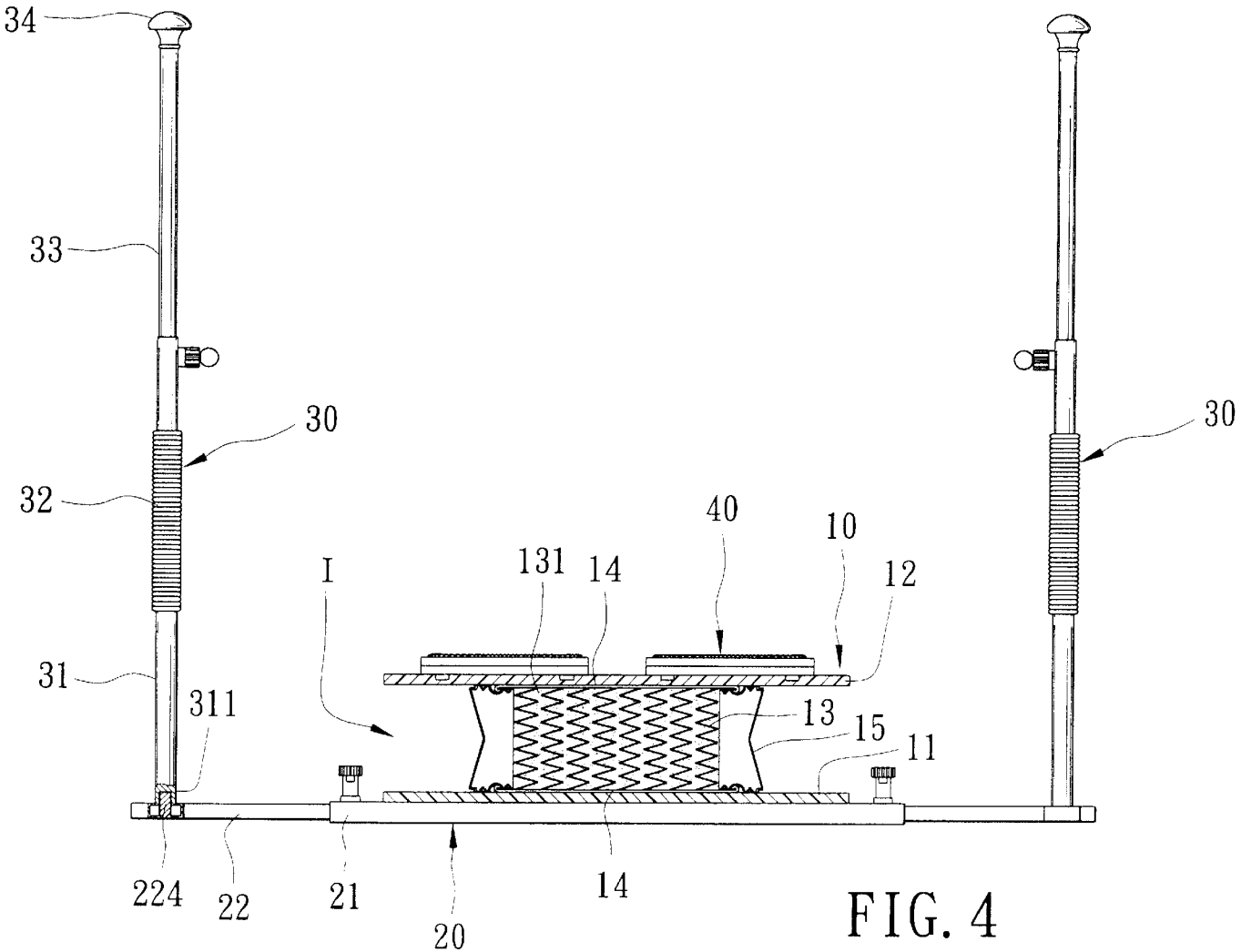
FIG. 4 is a partly sectional view of the first preferred embodiment.
Figure 5:
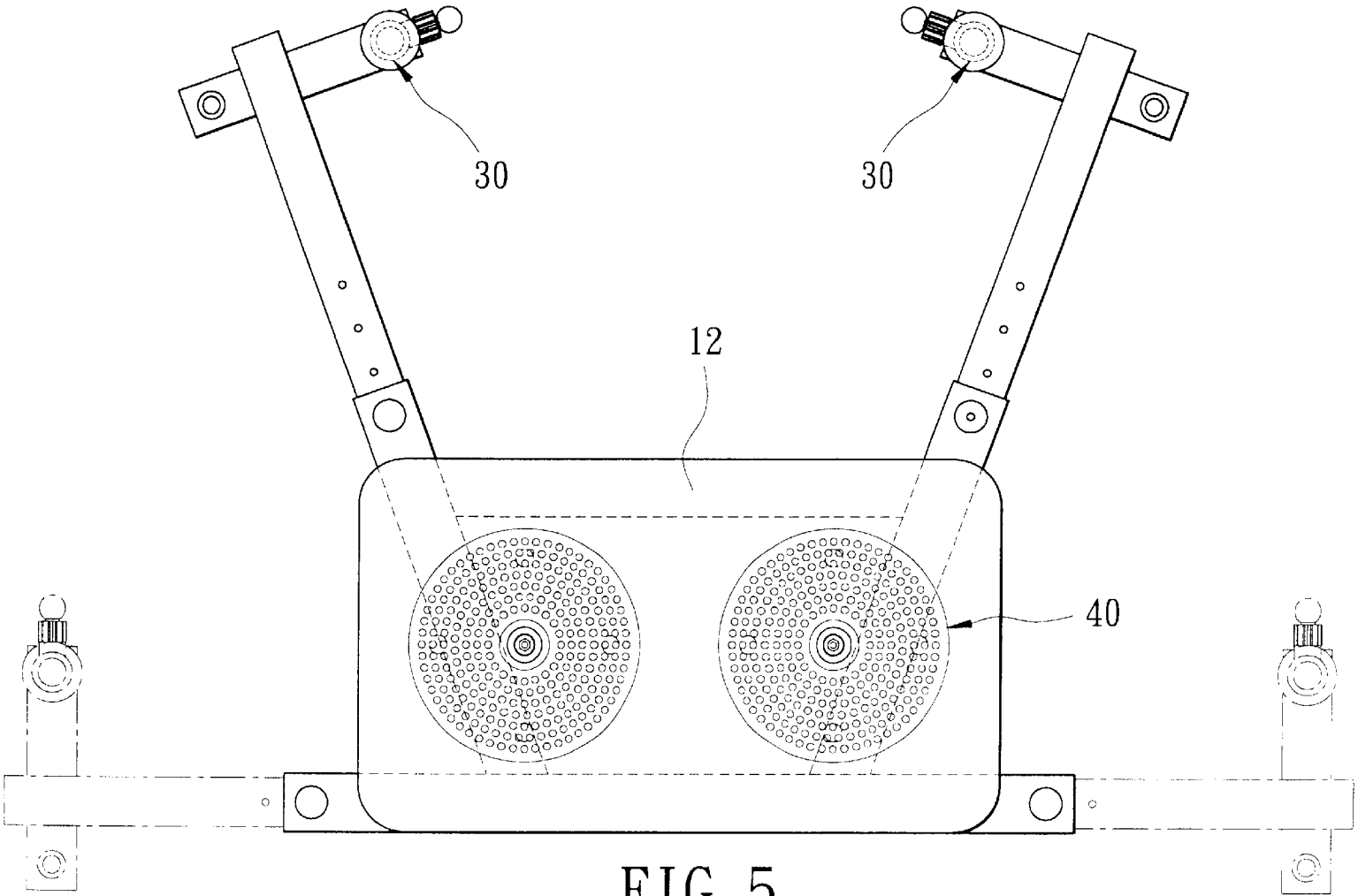
FIG. 5 is a schematic top view of the first preferred embodiment, illustrating how two positioning tubes can be disposed on the base tubes of a base support.

After the assembly, the top board 12 is supported by the first spring unit 13. Under normal circumstances, the top board 12 maintains an adequate height (I) relative to the bottom board 10, as shown in FIG. 4. The surrounding wall unit 15 covers the first spring unit 13 and the sound-absorbing cotton layers 14 such that the main frame 10 has an appealing appearance. The two exercising rod units 30 can be adjusted to different positions as desired, as shown in FIG. 5, so as to conform to the exercises to be performed. The rotatable disc units 40 can be mounted on or removed from the top board 12 of the main frame 10 as deemed appropriate.

Figure 6:
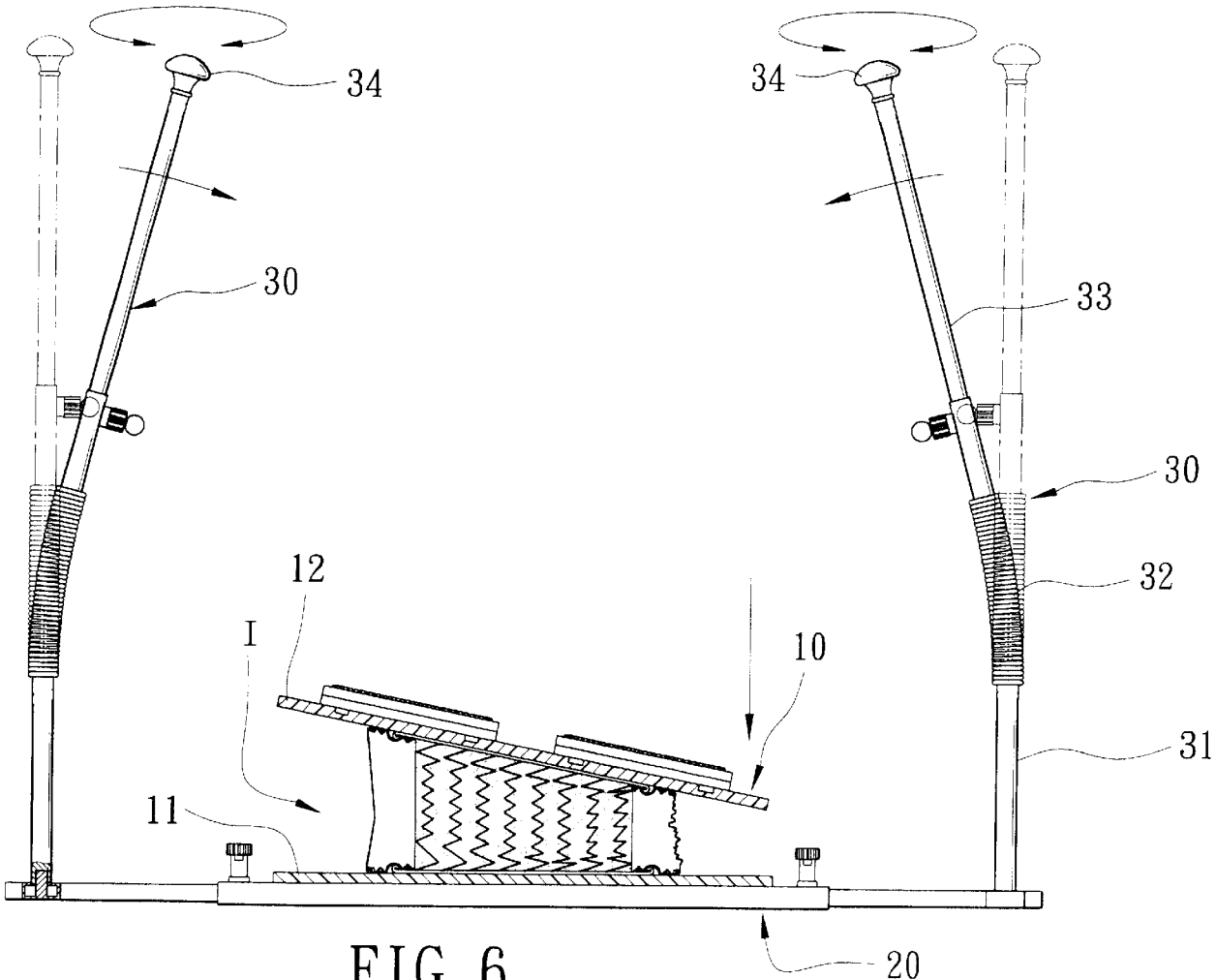
FIG. 6 illustrates how the first preferred embodiment works.

Referring to FIG. 6, when a downward pressure is exerted on one side of the top board 12, the top board 12 produces an angle variation relative to the bottom board 11 such that the height (I) varies. When the upper rod portions 33 of the exercising rod units 30 are pulled or rotated, the upper rod portions 33 can be bent to any desired angle due to flexibility of the second spring units 32. As such, the user can operate the upper rod portions 33 to turn by different angles relative to the lower rod portions 31, and can use the upper rod portions 33 as support for balance training. Furthermore, since the knobs 34 can be turned by 360° relative to the upper rod portions 33 and can facilitate rotation of the latter, the knobs 34 coordinate with the rod units 30 to produce different angle variations and rotations so that the hands can attain comfort, thereby achieving the purpose of training the wrists of the user.

Figure 7:
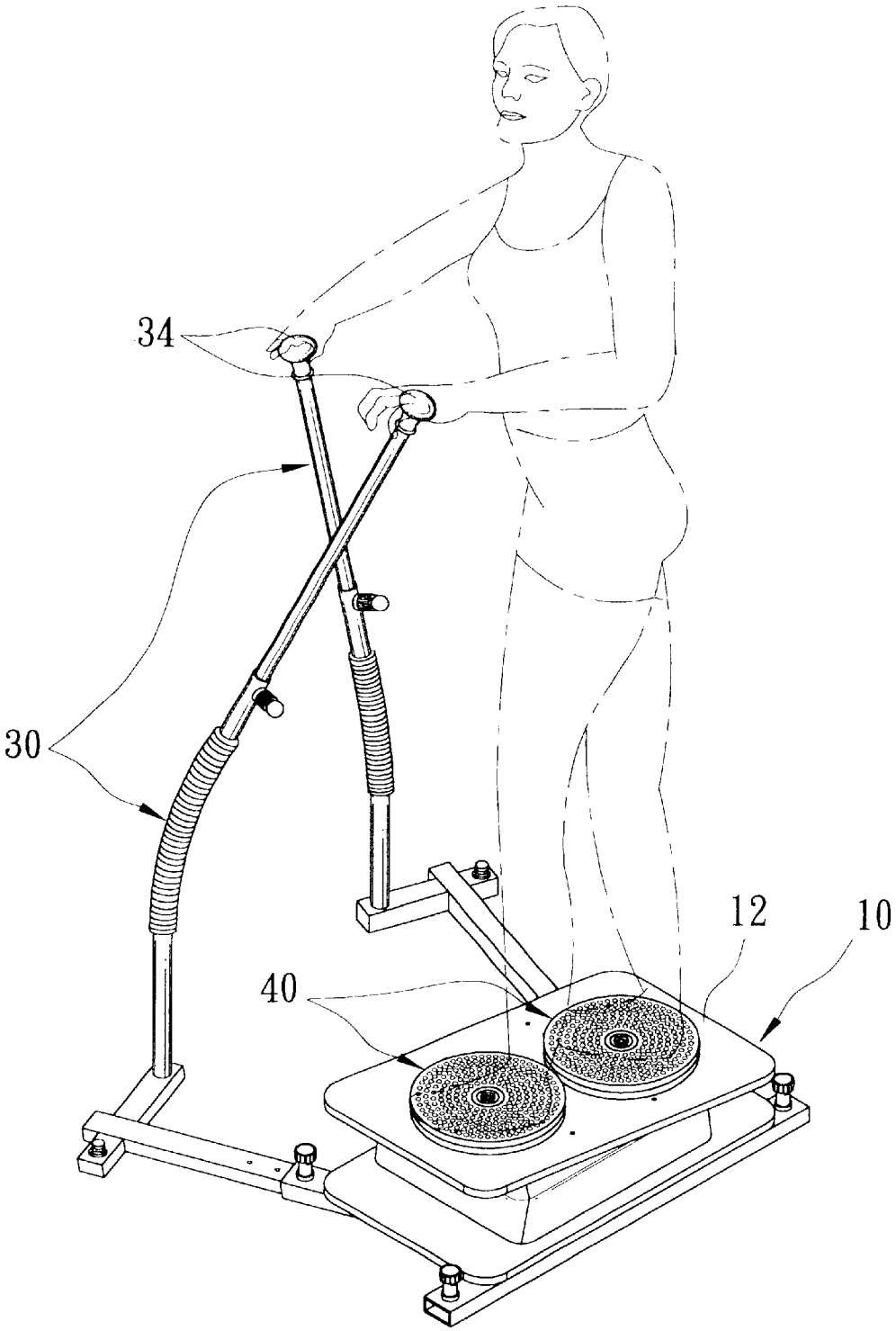
FIGS. 7 to 16 illustrate a series of exercises that can be performed using the first preferred embodiment.

Moreover, the following exercises can be performed using the first preferred embodiment of the present invention:

1. Referring to FIG. 7, the two rotatable disc units 40 are mounted on the main frame 10, and the two exercising rod units 30 are disposed parallel to each other. When the user steps on the disc units 40 and grasps the knobs 34 at the same time, twisting exercises can be performed. During exercise, the user has to use his feet to stably support him so as not to fall from the top board 12 and so as to balance different parts of his body. As such, training of the user's legs and waist can be achieved.

Figure 8:
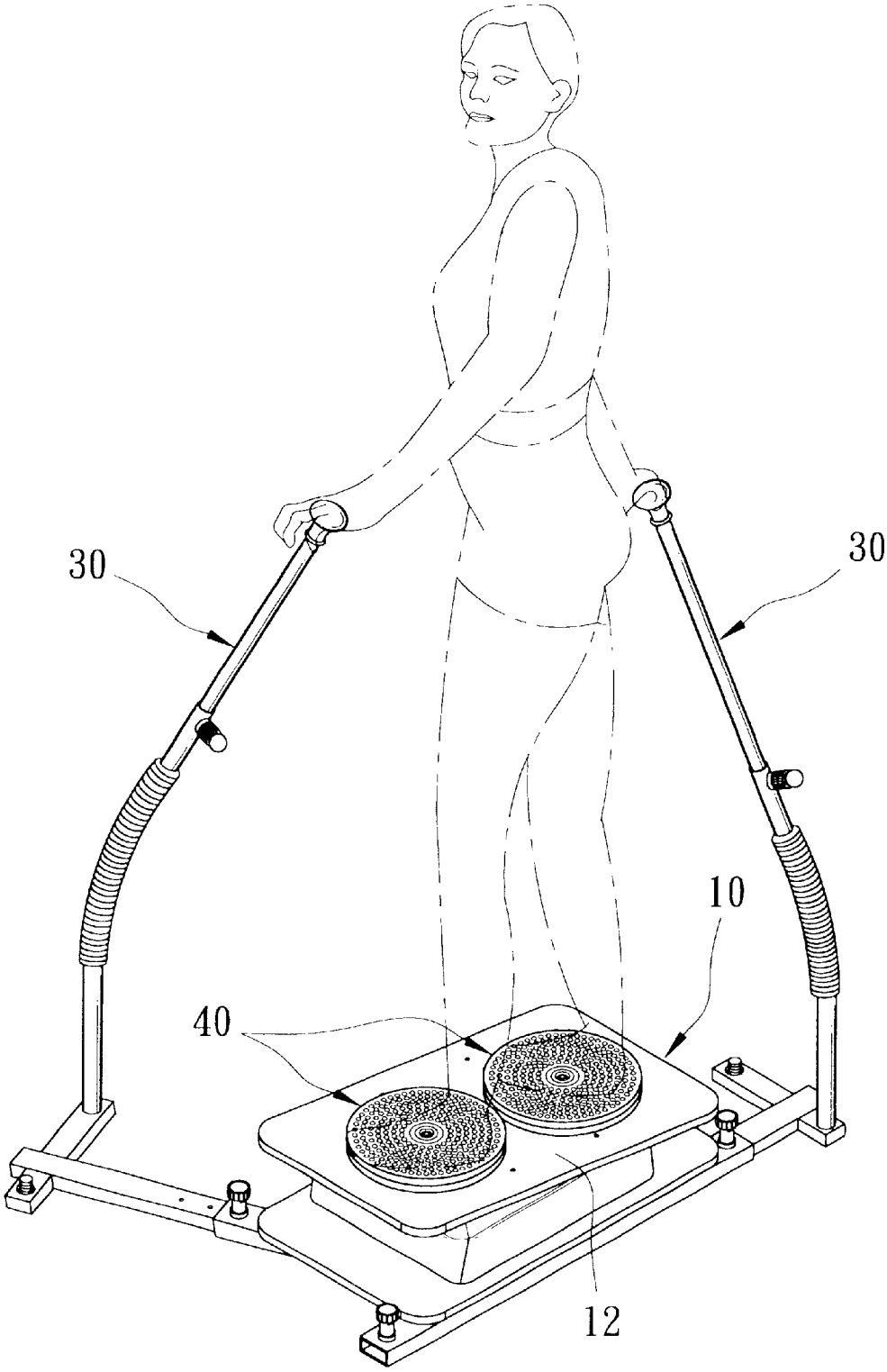

2. In this exercise, the two exercising rod units 30 are disposed opposite to each other in a slanting direction, as shown in FIG. 8. As such, greater stretching of the user's body occurs during exercise, thereby effectively training the user's waist.

Figure 9:
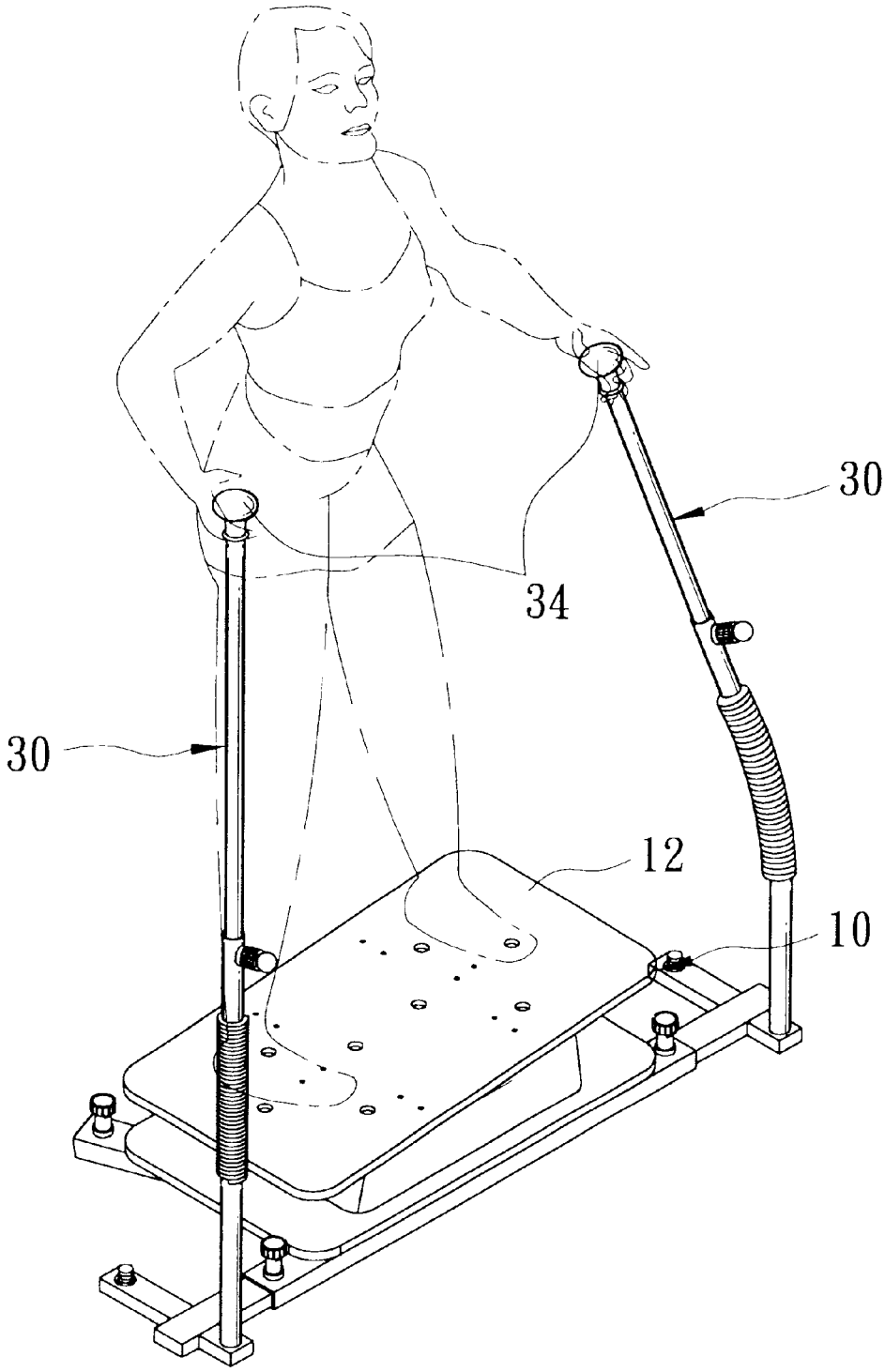

3. Referring to FIG. 9, the two exercising rod units 30 are disposed in alignment with each other. In this exercise, the rotatable disc units 40 (see FIG. 8) are not required. The user stands directly on the top board 12 with his hands gripping the knobs 34. Exercise begins by stepping on the left and right sides of the top board 12 alternately and continuously. The hands pull at the rod units 30 at the same time. Due to the flexible motion of the rod units 30 and buoyancy of the top board 12, training of the user's forearms and wrist muscles, and chest broadening are possible, thereby effecting yoga exercises.

Figure 10:
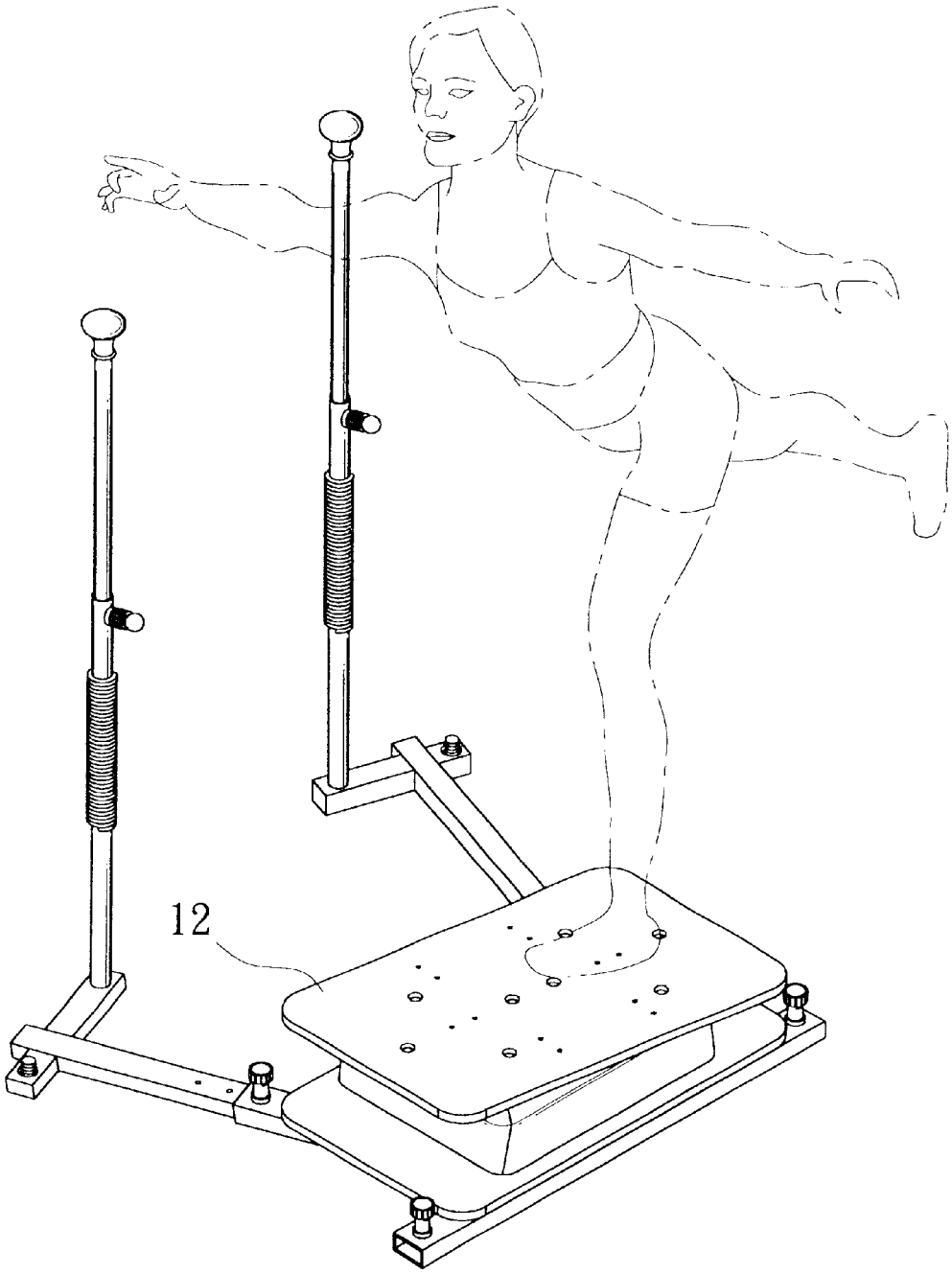

4. FIG. 10 illustrates the user standing on the top board 12 using a single foot. The single foot of the user has to support him stably so as not to fall from the top board 12, and has to balance different parts of his body, thereby effecting a single foot balance training and body training as well.

Figure 11:
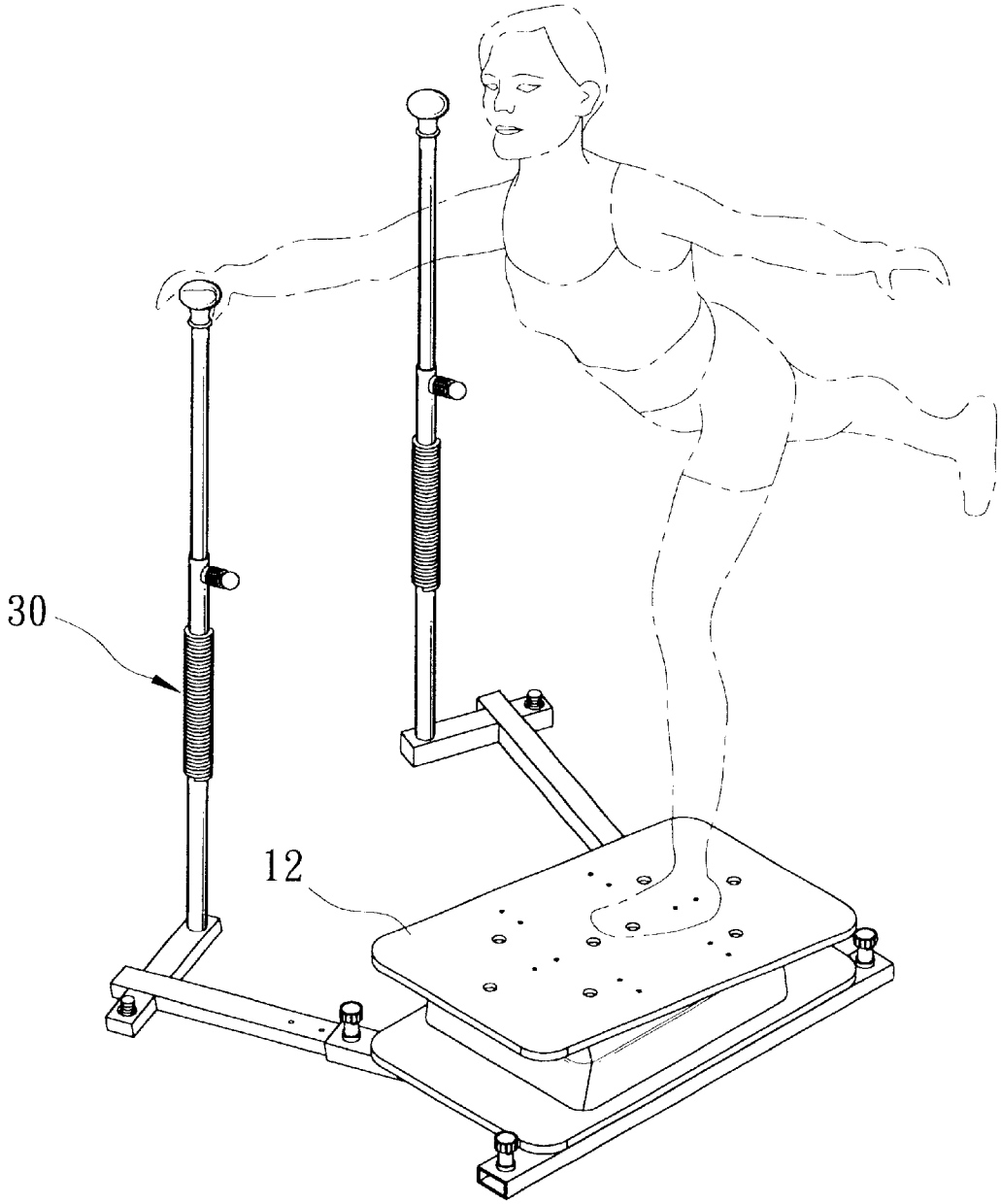

5. The exercise shown in FIG. 11 is substantially similar to the exercise shown in FIG. 10. However, in this exercise, the user has one hand gripping one of the exercising rod units 30 for support during balance training.

Figure 12:
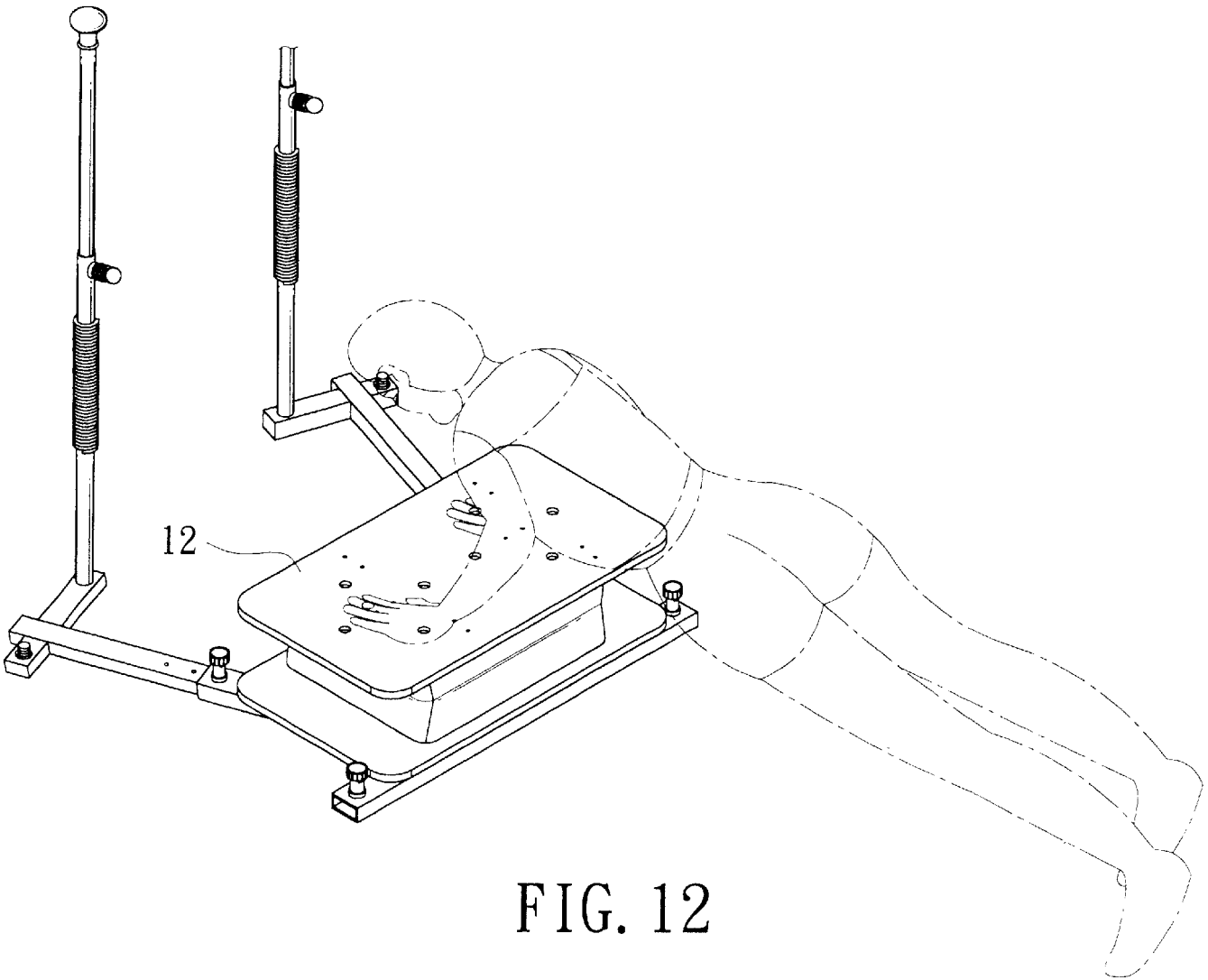

6. Referring to FIG. 12, when the user has both hands pressing against the top board 12 and the toes pressing against the ground, the user can proceed with a push-up exercise that promotes body training.

Figure 13:
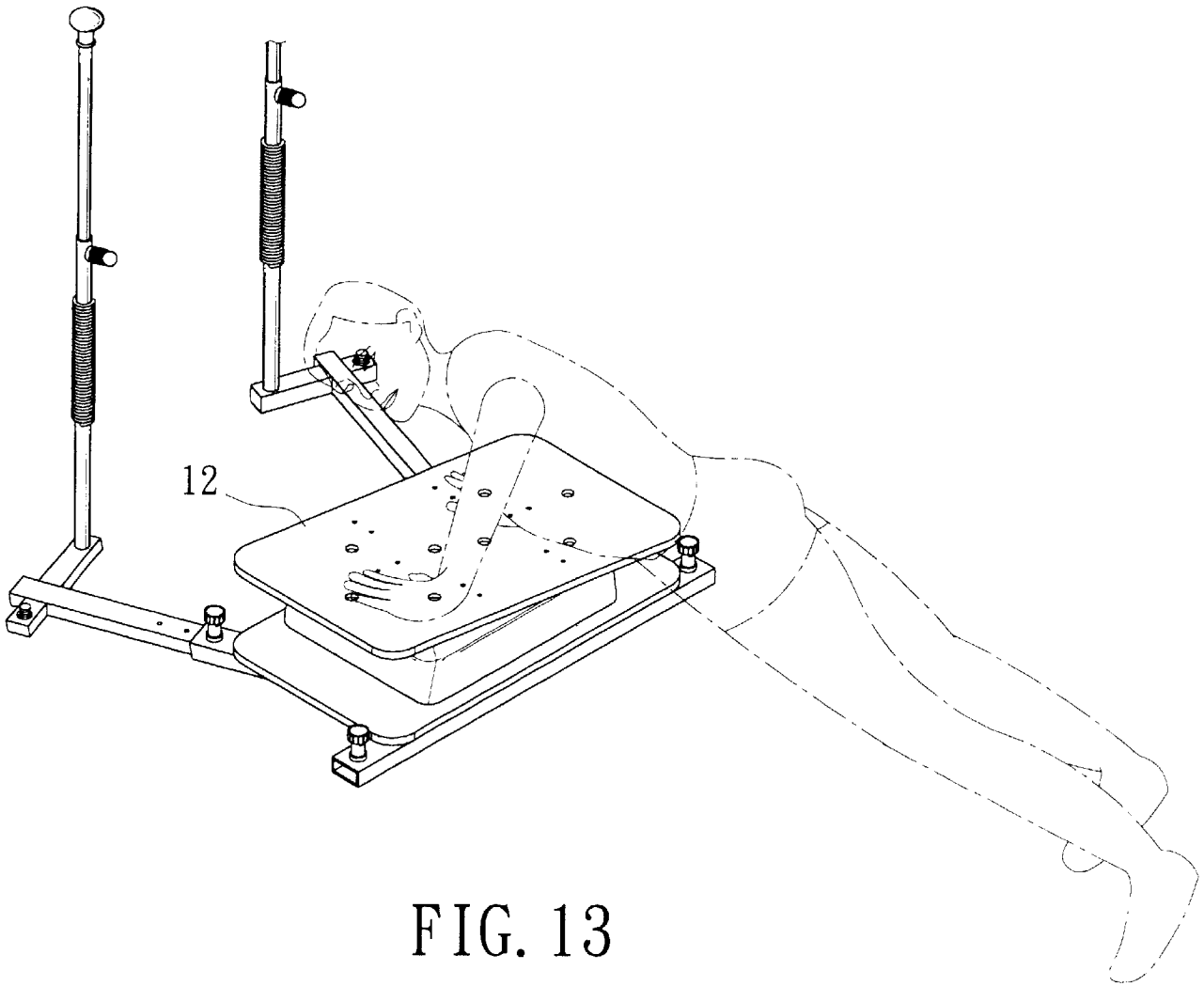

7. When both hands are stretched straight and press against the top board 12 with the toes pressing against the ground, exercise begins by exerting pressure on left and right sides of the top board 12 alternately and continuously, as shown in FIG. 13. Such exercise can train the forearms of the user.

Figure 14:
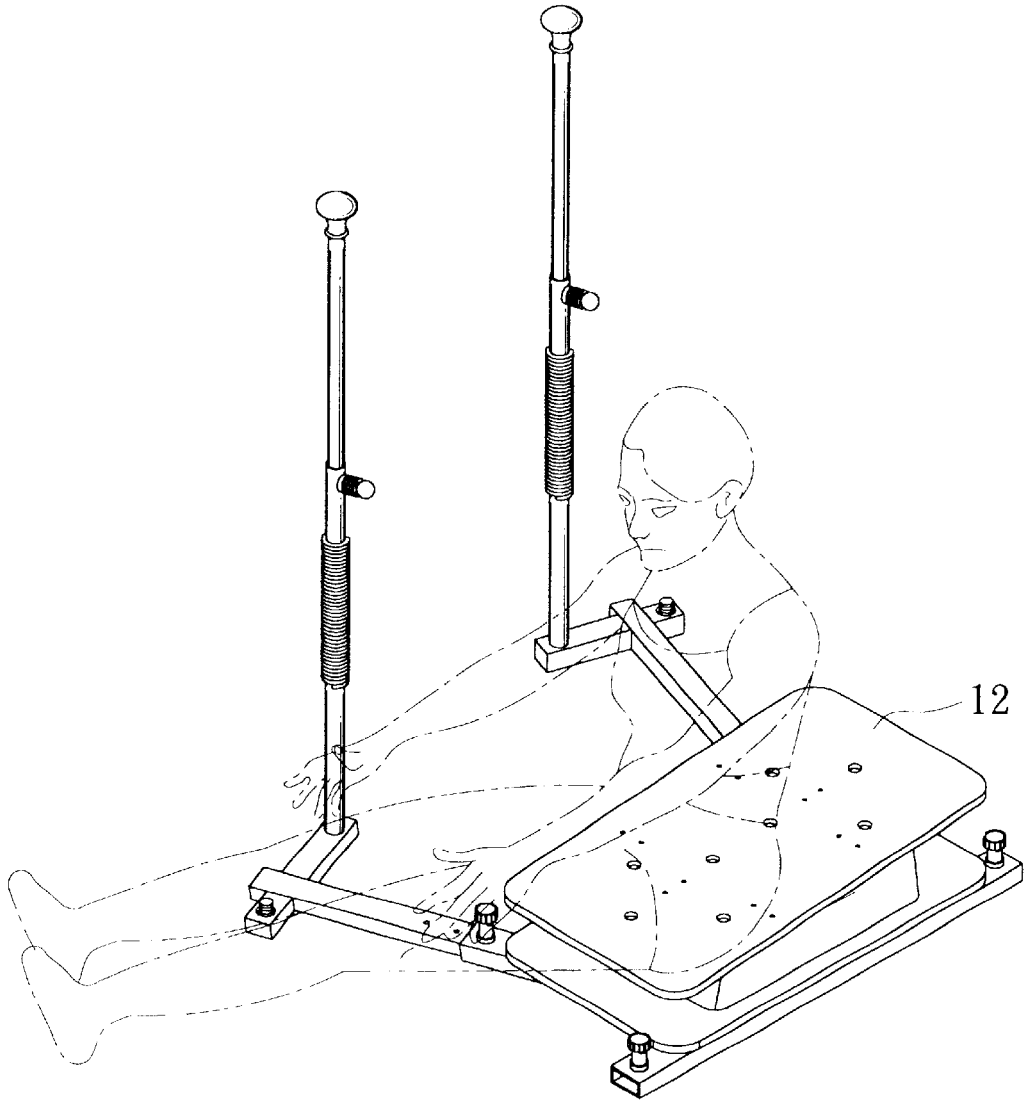

8. In this exercise, the user sits directly on the top board 12 with his feet and hands not touching the top board 12 or the ground surface (see FIG. 14). Such balancing and stretching can train waist and abdominal muscles of the user.

Figure 15:
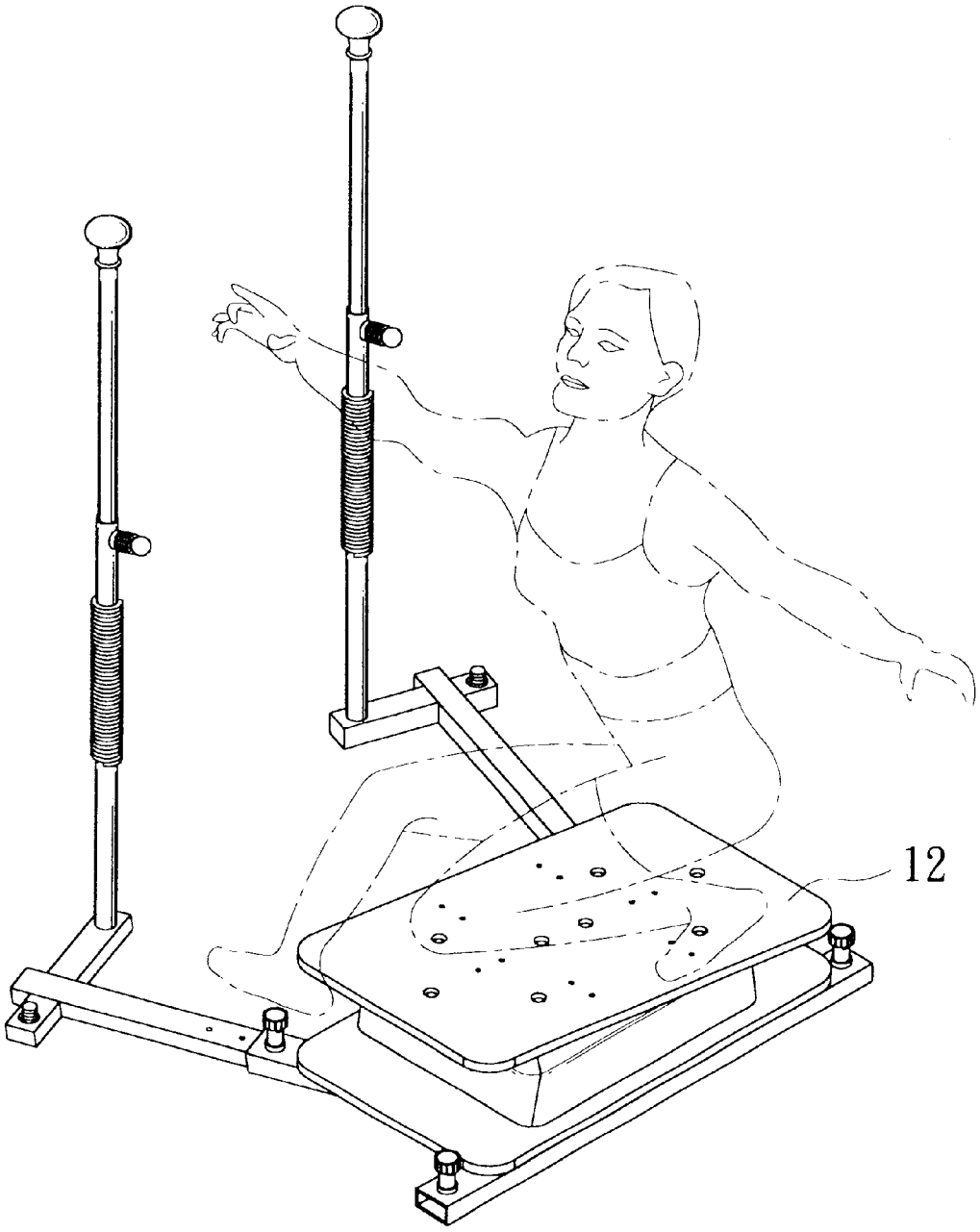

9. FIG. 15 illustrates the user squatting on a single foot on the top board 12. Such balancing helps train the leg muscles of the user.

Figure 16:
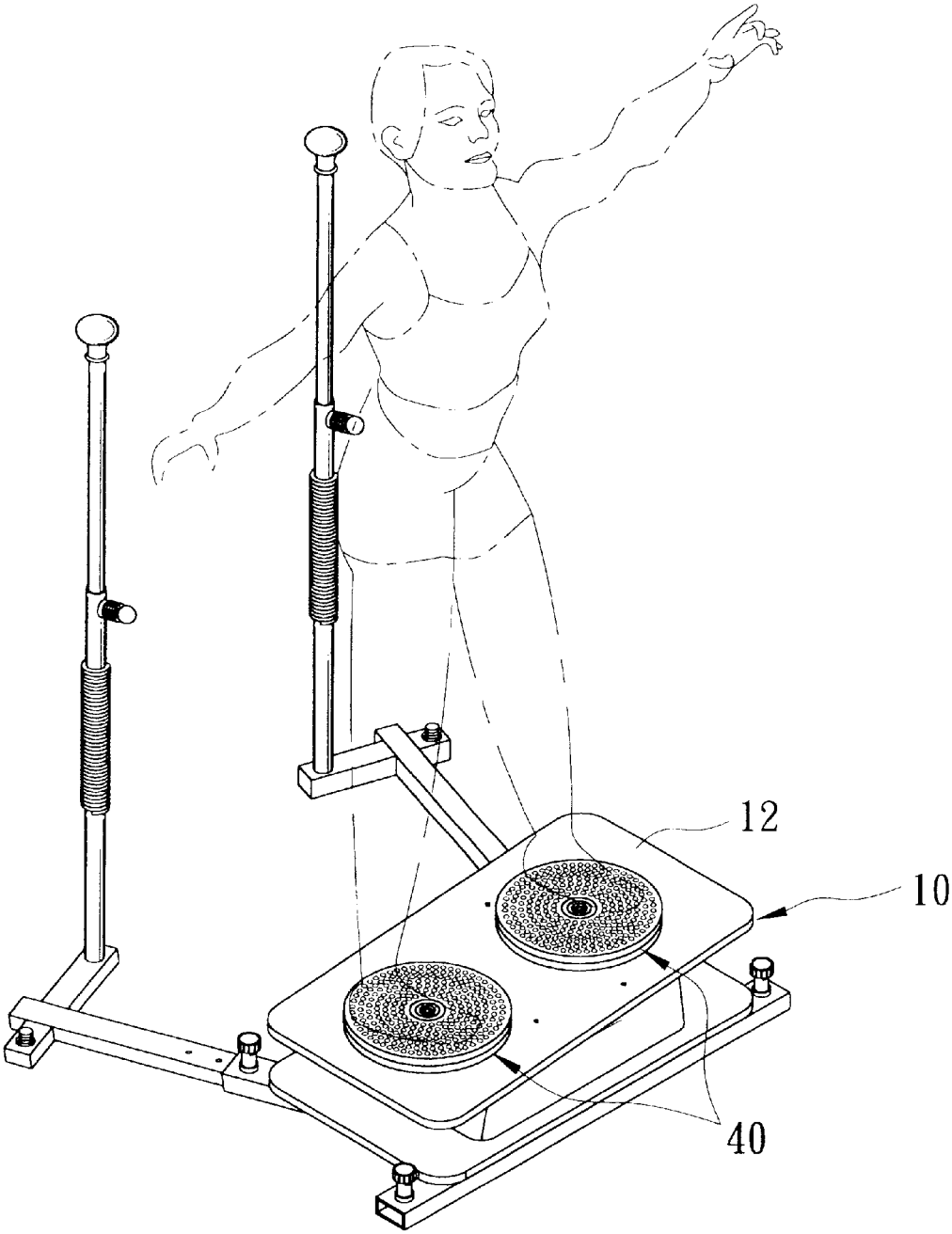

10. Referring to FIG. 16, the rotatable disc units 40 are mounted on the top board 12 of the main frame 10. In this exercise, the exercising rod units are not required so that when the user steps on the respective disc unit 40, the user has to use his feet to stably support him on the top board 12. Due to the left and right slanting motions of the top board 12 and due to the rotatable movement of the disc units 40, the user's feet have to coordinate with the different parts of the user's body so as to maintain balance on the top board 12 and so that the user can stably stand on the same. This exercise trains the waist, abdominal, and thigh muscles of the user.

11. An exercise that is similar to that shown in FIG. 16 but without the rotatable disc units can be performed. Such aero stepping board exercise (not shown) can similarly achieve the purpose of balance training.

It should be noted that since each positioning tube 22 has five positioning holes 223, each positioning tube 22 can have five different adjustable lengths relative to the respective one of the base tubes 21. Furthermore, the two exercising rod units 30 can be mounted on the two opposite ends of the same positioning tube 22, and can be mounted on different positioning tubes 22. As such, the rod units 30 can be adjusted to more than ten positions, thereby producing different angles and different positions of stretching exercises. Moreover, the inner tube 332 of the upper rod portion 33 of each rod unit 30 can be adjusted to different sections relative to the outer tube 331 so as to suit the height and body form of different users during stretching exercises.

Thus, the yoga balance trainer of the present invention uses the buoyancy of the top board 12 relative to the bottom board 11 and the 360° rotation of the upper rod portion 33 relative to the lower rod portion 31 of each exercising rod unit 30 to obtain a variety of balance training for the user, thereby increasing the user's confidence and harmony among each part of the user's body. As such, yoga and Tai-chi's soft and stretching exercises are possible.

Figure 17:
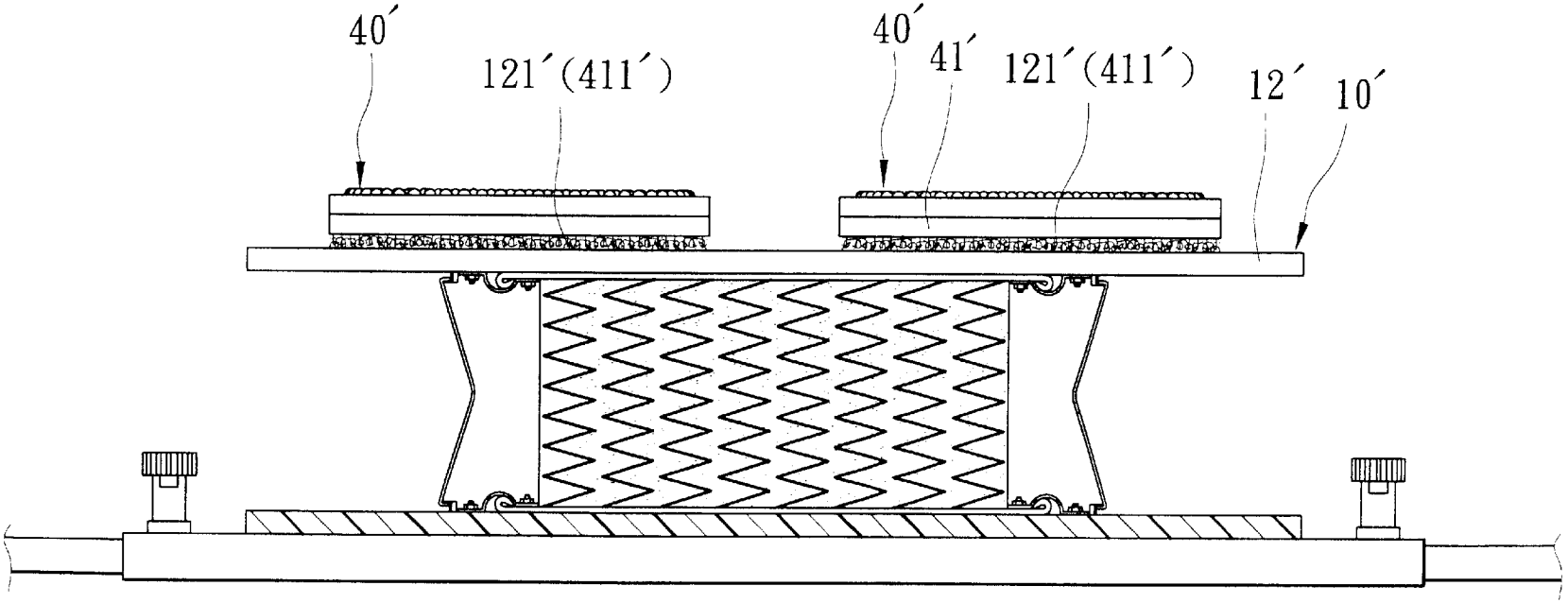
FIG. 17 is a fragmentary partly sectional view of the second preferred embodiment of a yoga balance trainer according to the present invention.

Referring to FIG. 17, the second preferred embodiment of a yoga balance trainer is shown to be substantially similar to the first preferred embodiment in construction. However, in this embodiment, the top board 12' of the main frame 10' has an upper surface provided with two sets of hook fasteners 121'. The lower disc portion 41' of each rotatable disc unit 40' has a bottom portion provided with a set of loop fasteners 411' that engages a respective one set of the hook fasteners 121' on the top board 12' so as to retain the lower disc portion 41' of each rotatable disc unit 40' removably on the top board 12' of the main frame 10'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A yoga balance trainer comprising:

a main frame including a hard bottom board, a hard top board opposite to said bottom board, and a first spring unit connected between said bottom and top boards so as to permit flexible movement of said top board relative to said bottom board;

a base support including a plurality of interconnecting base tubes connected fixedly to said bottom board of said main frame, a plurality of positioning tubes connected removably, telescopically, and respectively to said base tubes, and a plurality of positioning units for positioning said positioning tubes respectively relative to said base tubes; and at least two upright exercising rod units connected respectively and removably to selected two of said positioning tubes, each of said exercising rod units including a lower rod portion connected to the respective one of the selected two of said positioning tubes, an upper rod portion opposite to said lower rod portion, and a second spring unit connected between said lower and upper rod portions so that said upper rod portion is twistable relative to said lower rod portion.

2. The yoga balance trainer as claimed in claim 1, further comprising two horizontal rotatable disc units mounted removably on said top board of said main frame, each of said rotatable disc units having a horizontal lower disc portion mounted non-rotatably on said top board, and a horizontal upper disc portion opposite to said lower disc portion and rotatable relative to said lower disc portion.

3. The yoga balance trainer as claimed in claim 2, wherein said top board of said main frame has an upper surface formed with a plurality of vertical holes, said lower disc portion of each of said rotatable disc units having a bottom surface formed with a plurality of positioning posts that engage respectively said holes in said top board so as to prevent rotation of said lower disc portions of said rotatable disc units relative to said top board.

4. The yoga balance trainer as claimed in claim 2, wherein said top board of said main frame has an upper surface provided with a first hook-and-loop fastener, said lower disc portion of each of said rotatable disc units having a bottom portion provided with a second hook-and-loop fastener that engages said first hook-and-loop fastener so as to retain said lower disc portions of said rotatable disc units on said top board.

5. The yoga balance trainer as claimed in claim 1, wherein said upper rod portion of each of said upright exercising rod units includes an outer tube inserted into and fastened to said second spring unit, an inner tube inserted adjustably into said outer tube, and a retaining pin for retaining said inner tube on said outer tube, said outer tube having a retaining hole, said inner tube having a vertical row of positioning holes, said retaining pin extending through said retaining hole and into a selected one of said positioning holes.

6. The yoga balance trainer as claimed in claim 1, wherein each of said upright exercising rod units further includes a rotatable knob connected rotatably on a top end of said upper rod portion.

7. The yoga balance trainer as claimed in claim 1, wherein each of said positioning units of said base support includes a retaining hole formed in a respective one of said base tubes;

a horizontal row of positioning holes formed in a respective one of said positioning tubes; and a positioning pin extending through said retaining hole in the respective one of said base tubes and into a selected one of said positioning holes.

* * * * *